US006890872B2

(12) United States Patent
Bond et al.

(10) Patent No.: US 6,890,872 B2
(45) Date of Patent: May 10, 2005

(54) FIBERS COMPRISING STARCH AND BIODEGRADABLE POLYMERS

(75) Inventors: Eric Bryan Bond, Maineville, OH (US); Jean-Philippe Marie Autran, Wyoming, OH (US); Larry Neil Mackey, Fairfield, OH (US); Isao Noda, Fairfield, OH (US); Hugh Joseph O'Donnell, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 160 days.

(21) Appl. No.: 10/294,382

(22) Filed: Nov. 14, 2002

(65) Prior Publication Data

US 2003/0109605 A1 Jun. 12, 2003

Related U.S. Application Data

(63) Continuation-in-part of application No. 09/852,889, filed on May 10, 2001.

(51) Int. Cl.[7] ..... D04H 1/00; D04H 13/00; D04H 3/00; D04H 5/00

(52) U.S. Cl. ..... 442/414; 524/47

(58) Field of Search ..... 442/414; 524/47, 524/48, 49, 50, 51, 52, 53

(56) References Cited

U.S. PATENT DOCUMENTS

| | | | | |
|---|---|---|---|---|
| 4,139,699 | A | | 2/1979 | Hernandez et al. |
| 4,853,168 | A | | 8/1989 | Eden et al. |
| 5,316,578 | A | | 5/1994 | Buehler et al. |
| 5,417,679 | A | | 5/1995 | Toms et al. |
| 5,422,387 | A | | 6/1995 | Toms et al. |
| 5,425,987 | A | | 6/1995 | Shawver et al. |
| 5,516,815 | A | | 5/1996 | Buehler et al. |
| 5,593,768 | A | | 1/1997 | Gessner |
| 5,593,778 | A | | 1/1997 | Kondo et al. |
| 5,703,160 | A | | 12/1997 | Dehennau et al. |
| 5,814,404 | A | | 9/1998 | Rutherford et al. |
| 5,851,937 | A | | 12/1998 | Wu et al. |
| 5,874,486 | A | | 2/1999 | Bastioli et al. |
| 5,939,467 | A | * | 8/1999 | Wnuk et al. ..... 523/128 |
| 5,945,480 | A | | 8/1999 | Wang et al. |
| 5,985,776 | A | | 11/1999 | Bertrand et al. |
| 6,045,908 | A | | 4/2000 | Nakajima et al. |
| 6,096,809 | A | | 8/2000 | Lorcks et al. |
| 6,117,925 | A | | 9/2000 | Tomka |
| 6,218,321 | B1 | | 4/2001 | Lorcks et al. |
| 6,376,072 | B1 | | 4/2002 | Evans et al. |
| 6,451,170 | B1 | | 9/2002 | Anderson et al. |
| 6,506,873 | B1 | | 1/2003 | Ryan et al. |

FOREIGN PATENT DOCUMENTS

| | | | |
|---|---|---|---|
| EP | 1 035 163 | A2 | 9/2000 |
| EP | 1 035 239 | A2 | 9/2000 |
| EP | 1217106 | A1 | 6/2002 |
| EP | 1217107 | A1 | 6/2002 |
| GB | 1 247 474 | | 9/1971 |
| JP | 04100913 | | 4/1992 |
| JP | 96027627 | A | 1/1996 |
| JP | 82-28410 | | 2/1997 |
| JP | 97041224 | | 2/1997 |
| JP | 9276331 | | 10/1997 |
| JP | 1008384 | | 1/1998 |
| WO | WO 01/48508 | A2 | 6/2001 |
| WO | WO 01/48078 | A1 | 7/2001 |
| WO | WO 01/49912 | A1 | 7/2001 |

OTHER PUBLICATIONS

Fringant, C., et al., "Preparation of Mixed Esters of Starch or Use of an External Plasticizer: Two Different Ways to Change the Properties of Starch Acrtate Films", Carbohydrate Polymers 35 (1998) 97–106, Elsevier Science, Ltd.

Glenn, G. M., et al., "Starch, Fiber and $CaCO_3$ Effects on the Physical Properties of Foams Made by a Balding Process," Industrial Crops and Products 14 (2001) 201–212, Elsevier Science, Ltd.

Jandura, P., et al., "Thermal Degradation Behavior of Cellulose Fibers Partially Esterified with Some Long Chain Organic Acide", Polymer Degradation and Stability 70 (2000) 387–394, Elsevier Science, Ltd.

* cited by examiner

*Primary Examiner*—James J. Seidleck
*Assistant Examiner*—U. K. Rajguru
(74) *Attorney, Agent, or Firm*—Angela Marie Stone; Leonard W. Lewis

(57) ABSTRACT

Environmentally degradable finely attenuated fibers produced by melt spinning a composition comprising destructurized starch, a biodegradable thermoplastic polymer, and a plasticizer are disclosed. The present invention is also directed to highly attenuated fibers containing thermoplastic polymer microfibrils which are formed within the starch matrix of the finely attenuated fiber. Nonwoven webs and disposable articles comprising the highly attenuated fibers are also disclosed.

4 Claims, 1 Drawing Sheet

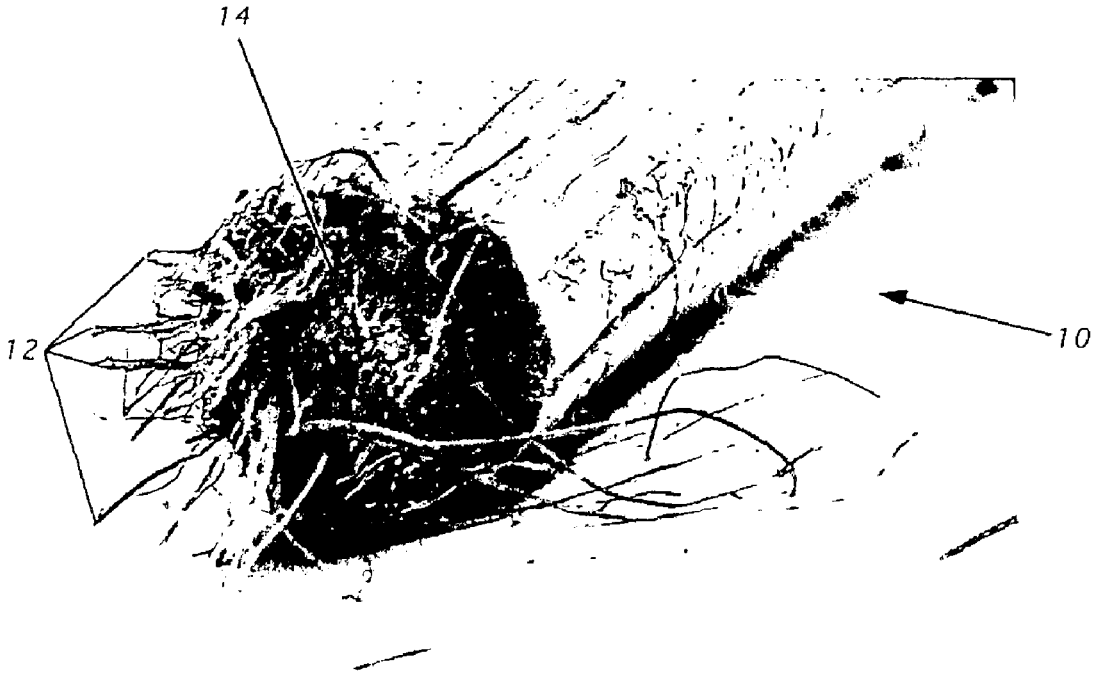
14
12
10

FIBERS COMPRISING STARCH AND BIODEGRADABLE POLYMERS

CROSS REFERENCE TO RELATED PATENTS

This application is a continuation-in-part and claims priority to co-pending and commonly owned U.S. applications Ser. No. 09/852,889, filed May 10, 2001.

FIELD OF THE INVENTION

The present invention relates to environmentally degradable fibers comprising starch and biodegradable polymers, processes of making the fibers, and specific configurations of the fibers, including microfibrils. The fibers are used to make nonwoven webs and disposable articles.

BACKGROUND OF THE INVENTION

There have been many attempts to make environmentally degradable articles. However, because of costs, the difficultly in processing, and end-use properties there has been little commercial success. Many compositions that have excellent degradability have only limited processability. Conversely, compositions which are more easily processable have reduced biodegradability, dispersability, and flushability.

Useful fibers with excellent environmental degradability for nonwoven articles are difficult to produce and pose additional challenges compared to films and laminates. This is because the material and processing characteristics for fibers is much more stringent than for producing films, blow-molding articles, and injection-molding articles. For the production of fibers, the processing time during structure formation is typically much shorter and flow characteristics are more demanding on the material's physical and theological characteristics. The local strain rate and shear rate is much greater in fiber production than other processes. Additionally, a homogeneous composition is required for fiber spinning. For spinning very fine fibers, small defects, slight inconsistencies, or non-homogeneity in the melt are not acceptable for a commercially viable process. The more attenuated the fibers, the more critical the processing conditions and selection of materials.

To produce environmentally degradable articles, attempts have been made to process natural starch on standard equipment and existing technology known in the plastic industry. Since natural starch generally has a granular structure, it needs to be "destructurized" before it can be melt processed into fine denier filaments. Modified starch (alone or as the major component of a blend) has been found to have poor melt extensibility, resulting in difficulty in successfully production of fibers, films, foams or the like. Additionally, starch fibers are difficult to spin and are virtually unusable to make nonwovens due to the low tensile strength, stickiness, and the inability to be bonded to form nonwovens.

To produce fibers that have more acceptable processability and end-use properties, biodegradable polymers need to be combined with starch. Selection of a suitable biodegradable polymer that is acceptable for blending with starch is challenging. The biodegradable polymer must have good spinning properties and a suitable melting temperature. The melting temperature must be high enough for end-use stability to prevent melting or structural deformation, but not too high of a melting temperature to be able to be processable with starch without burning the starch. These requirements make selection of a biodegradable polymer to produce starch-containing fibers very difficult.

Consequently, there is a need for a cost-effective and easily processable composition made of natural starches and biodegradable polymers. Moreover, the starch and polymer composition should be suitable for use in conventional processing equipment. There is also a need for disposable nonwoven articles made from these fiber which are environmentally degradable.

SUMMARY OF THE INVENTION

The present invention is directed to highly attenuated fibers produced by melt spinning a composition comprising destructurized starch, a biodegradable thermoplastic polymer, and a plasticizer. The present invention is also directed towards fibers containing two or more biodegradable thermoplastic polymers. Preferably, one of the biodegradable thermoplastic polymers is a crystallizable polylactic acid.

The present invention is also directed to highly attenuated fibers containing thermoplastic polymer microfibrils which are formed within the starch matrix of the highly attenuated fiber. The present invention is also directed to nonwoven webs and disposable articles comprising the highly attenuated fibers.

BRIEF DESCRIPTION OF THE DRAWINGS

These and other features, aspects and advantages of the present invention will become better understood with regard to the following description, appended claims, and accompanying drawing where:

FIG. 1 illustrates a fiber containing microfibrils.

DETAILED DESCRIPTION OF THE INVENTION

All percentages, ratios and proportions used herein are by weight percent of the composition, unless otherwise specified. Examples in the present application are listed in parts of the total composition. All average values are calculated "by weight" of the composition or components thereof, unless otherwise expressly indicated. "Average molecular weight", or "molecular weight" for polymers, unless otherwise indicated, refers to number average molecular weight. Number average molecular weight, unless otherwise specified, is determined by gel permeation chromatography. All patents or other publications cited herein are incorporated herein by reference with respect to all text contained therein for the purposes for which the reference was cited. Inclusion of any such patents or publications is not intended to be an admission that the cited reference is citable as prior art or that the subject matter therein is material prior art against the present invention. The compositions, products, and processes described herein may comprise, consist essentially of, or consist of any or all of the required and/or optional components, ingredients, compositions, or steps described herein.

The specification contains a detailed description of (1) materials of the present invention, (2) configuration of the fibers, (3) material properties of the fibers, (4) processes, and (5) articles.

(1) Materials

Starch

The present invention relates to the use of starch, a low cost naturally occurring polymer. The starch used in the present invention is destructurized starch, which is necessary for adequate spinning performance and fiber properties. The term "thermoplastic starch" means destructured starch with a plasticizer.

Since natural starch generally has a granular structure, it needs to be destructurized before it can be melt processed and spun like a thermoplastic material. For gelatinization, the starch can be destructurized in the presence of a solvent which acts as a plasticizer. The solvent and starch mixture is heated, typically under pressurized conditions and shear to accelerate the gelatinization process. Chemical or enzymatic agents may also be used to destructurize, oxidize, or derivatize the starch. Commonly, starch is destructurized by dissolving the starch in water. Fully destructured starch results when no lumps impacting the fiber spinning process are present.

Suitable naturally occurring starches can include, but are not limited to, corn starch, potato starch, sweet potato starch, wheat starch, sago palm starch, tapioca starch, rice starch, soybean starch, arrow root starch, bracken starch, lotus starch, cassava starch, waxy maize starch, high amylose corn starch, and commercial amylose powder. Blends of starch may also be used. Though all starches are useful herein, the present invention is most commonly practiced with natural starches derived from agricultural sources, which offer the advantages of being abundant in supply, easily replenishable and inexpensive in price. Naturally occurring starches, particularly corn starch, wheat starch, and waxy maize starch, are the preferred starch polymers of choice due to their economy and availability.

Modified starch may also be used. Modified starch is defined as non-substituted or substituted starch that has had its native molecular weight characteristics changed (i.e. the molecular weight is changed but no other changes are necessarily made to the starch). If modified starch is desired, chemical modifications of starch typically include acid or alkali hydrolysis and oxidative chain scission to reduce molecular weight and molecular weight distribution. Natural, unmodified starch generally has a very high average molecular weight and a broad molecular weight distribution (e.g. natural corn starch has an average molecular weight of up to about 60,000,000 grams/mole (g/mol)). The average molecular weight of starch can be reduced to the desirable range for the present invention by acid reduction, oxidation reduction, enzymatic reduction, hydrolysis (acid or alkaline catalyzed), physical/mechanical degradation (e.g., via the thermomechanical energy input of the processing equipment), or combinations thereof. The thermomechanical method and the oxidation method offer an additional advantage when carried out in situ. The exact chemical nature of the starch and molecular weight reduction method is not critical as long as the average molecular weight is in an acceptable range. Ranges of number average molecular weight for starch or starch blends added to the melt can be from about 3,000 g/mol to about 8,000,000 g/mol, preferably from about 10,000 g/mol to about 5,000,000 g/mol, preferably from about 10,000 to about 2,000,000 g/mol, more preferably from about 20,000 g/mol to about 3,000,000 g/mol. In other embodiments, the average molecular weight is otherwise within the above ranges but about 1,000,000 or less, or about 700,000 or less. Although not required, substituted starch can be used. If substituted starch is desired, chemical modifications of starch typically include etherification and esterification. Substituted starches may be desired for better compatibility or miscibility with the thermoplastic polymer and plasticizer. However, this must be balanced with the reduction in their rate of degradability. The degree of substitution of the chemically substituted starch is from about 0.01 to 3.0. A low degree of substitution, 0.01 to 0.06, may be preferred.

Typically, the composition comprises from about 5% to about 85%, preferably from about 20% to about 80%, more preferably from about 30% to about 70%, and most preferably from about 40% to about 60%, of starch. The weight of starch in the composition includes starch and its naturally occurring bound water content. The term "bound water" means the water found naturally occurring in starch and before mixing of starch with other components to make the composition of the present invention. The term "free water" means the water that is added in making the composition of the present invention. A person of ordinary skill in the art would recognize that once the components are mixed in a composition, water can no longer be distinguished by its origin. The starch typically has a bound water content of about 5% to 16% by weight of starch. It is known that additional free water may be incorporated as the polar solvent or plasticizer, and not included in the weight of the starch.

Biodegradable Thermoplastic Polymers

Biodegradable thermoplastic polymers which are substantially compatible with starch are also required in the present invention. As used herein, the term "substantially compatible" means when heated to a temperature above the softening and/or the melting temperature of the composition, the polymer is capable of forming a substantially homogeneous mixture with the starch after mixing with shear or extension. The thermoplastic polymer used must be able to flow upon heating to form a processable melt and resolidify as a result of crystallization or vitrification.

The polymer must have a melting temperature sufficiently low to prevent significant degradation of the starch during compounding and yet be sufficiently high for thermal stability during use of the fiber. Suitable melting temperatures of biodegradable polymers are from about 80° to about 190° C. and preferably from about 90° to about 180° C. Thermoplastic polymers having a melting temperature above 190° C. may be used if plasticizers or diluents are used to lower the observed melting temperature. The polymer must have theological characteristics suitable for melt spinning. The molecular weight of the degradable polymer must be sufficiently high to enable entanglement between polymer molecules and yet low enough to be melt spinnable. For melt spinning, biodegradable thermoplastic polymers can have molecular weights below 500,000 g/mol, preferably from about 10,000 g/mol to about 400,000 g/mol, more preferable from about 50,000 g/mol to about 300,000 g/mol and most preferably from about 100,000 g/mol to about 200,000 g/mol.

The biodegradable thermoplastic polymers must be able to solidify fairly rapidly, preferably under extensional flow, and form a thermally stable fiber structure, as typically encountered in known processes as staple fibers (spin draw process) or spunbond continuous filament process.

The biodegradable polymers suitable for use herein are those biodegradable materials which are susceptible to being assimilated by microorganisms such as molds, fungi, and bacteria when the biodegradable material is buried in the ground or otherwise comes in contact with the microorganisms including contact under environmental conditions conducive to the growth of the microorganisms. Suitable biodegradable polymers also include those biodegradable materials which are environmentally degradable using aerobic or anaerobic digestion procedures, or by virtue of being exposed to environmental elements such as sunlight, rain, moisture, wind, temperature, and the like. The biodegradable thermoplastic polymers can be used individually or as a combination of polymers provided that the biodegradable thermoplastic polymers are degradable by biological and environmental means.

Nonlimiting examples of biodegradable thermoplastic polymers suitable for use in the present invention include aliphatic polyesteramides; diacids/diols aliphatic polyesters; modified aromatic polyesters including modified polyethylene terephtalates, modified polybutylene terephtalates; aliphatic/aromatic copolyesters; polycaprolactones; poly(3-hydroxyalkanoates) including poly(3-hydroxybutyrates), poly(3-hydroxyhexanoates, and poly(3-hydroxyvalerates); poly(3-hydroxyalkanoates) copolymers, poly (hydroxybutyrate-co-hydroxyvalerate), poly (hydroxybutyrate-co-hexanoate) or other higher poly (hydroxybutyrate-co-alkanoates) as references in U.S. Pat. No. 5,498,692 to Noda, herein incorporated by reference; polyesters and polyurethanes derived from aliphatic polyols (i.e., dialkanoyl polymers); polyamides including polyethylene/vinyl alcohol copolymers; lactic acid polymers including lactic acid homopolymers and lactic acid copolymers; lactide polymers including lactide homopolymers and lactide copolymers; glycolide polymers including glycolide homopolymers and glycolide copolymers; and mixtures thereof. Preferred are aliphatic polyesteramides, diacids/diols aliphatic polyesters, aliphatic/aromatic copolyesters, lactic acid polymers, and lactide polymers.

Specific examples of aliphatic polyesteramides suitable for use as a biodegradable thermoplastic polymer herein include, but are not limited to, aliphatic polyesteramides which are reaction products of a synthesis reaction of diols, dicarboxylic acids, and aminocarboxylic acids; aliphatic polyesteramides formed from reacting lactic acid with diamines and dicarboxylic acid dichlorides; aliphatic polyesteramides formed from caprolactone and caprolactam; aliphatic polyesteramides formed by reacting acid-terminated aliphatic ester prepolymers with aromatic diisocyanates; aliphatic polyesteramides formed by reacting aliphatic esters with aliphatic amides; and mixtures thereof. Aliphatic polyesteramides formed by reacting aliphatic esters with aliphatic amides are most preferred. Also suitable in the present invention are polyvinyl alcohol and its copolymers.

Aliphatic polyesteramides which are copolymers of aliphatic esters and aliphatic amides can be characterized in that these copolymers generally contain from about 30% to about 70%, preferably from about 40% to about 80% by weight of aliphatic esters, and from about 30% to about 70%, preferably from about 20% to about 60% by weight of aliphatic amides. The weight average molecular weight of these copolymers range from about 10,000 g/mol to about 300,000 g/mol, preferably from about 20,000 g/mol to about 150,000 g/mol as measured by the known gel chromatography technique used in the determination of molecular weight of polymers.

The aliphatic ester and aliphatic amide copolymers of the preferred aliphatic polyesteramides are derived from monomers such as dialcohols including ethylene glycol, diethylene glycol, 1,4-butanediol, 1,3-propanediol, 1,6-hexanediol, and the like; dicarboxylic acids including oxalic acid, succinic acid, adipic acid, oxalic acid esters, succinic acid esters, adipic acid esters, and the like; hydroxycarboxylic acid and lactones including caprolactone, and the like; aminoalcohols including ethanolamine, propanolamine, and the like; cyclic lactams including ϵ-caprolactam, lauric lactam, and the like; ω-aminocarboxylic acids including aminocaproic acid, and the like; 1:1 salts of dicarboxylic acids and diamines including 1:1 salt mixtures of dicarboxylic acids such as adipic acid, succinic acid, and the like, and diamines such as hexamethylenediamine, diaminobutane, and the like; and mixtures thereof. Hydroxy-terminated or acid-terminated polyesters such as acid terminated oligoesters can also be used as the ester-forming compound. The hydroxy-terminated or acid terminated polyesters typically have weight or number average molecular weights of from about 200 g/mol to about 10,000 g/mol.

The aliphatic polyesteramides can be prepared by any suitable synthesis or stoichiometric technique known in the art for forming aliphatic polyesteramides having aliphatic ester and aliphatic amide monomers. A typical synthesis involves stoichiometrically mixing the starting monomers, optionally adding water to the reaction mixture, polymerizing the monomers at an elevated temperature of about 220° C., and subsequently removing the water and excess monomers by distillation using vacuum and elevated temperature, resulting in a final copolymer of an aliphatic polyesteramide. Other suitable techniques involve transesterification and transamidation reaction procedures. As apparent by those skilled in the art, a catalyst can be used in the above-described synthesis reaction and transesterification or transamidation procedures, wherein suitable catalysts include phosphorous compounds, acid catalysts, magnesium acetates, zinc acetates, calcium acetates, lysine, lysine derivatives, and the like.

The preferred aliphatic polyesteramides comprise copolymer combinations of adipic acid, 1,4-butanediol, and 6-aminocaproic acid with an ester portion of 45%; adipic acid, 1,4-butanediol, and ϵ-caprolactam with an ester portion of 50%; adipic acid, 1,4-butanediol, and a 1:1 salt of adipic acid and 1,6-hexamethylenediamine; and an acid-terminated oligoester made from adipic acid, 1,4-butanediol, 1,6-hexamethylenediamine, and ϵ-caprolactam. These preferred aliphatic polyesteramides have melting points of from about 115° C. to about 155° C. and relative viscosities (1 wt. % in m-cresol at 25° C.) of from about 2.0 to about 3.0, and are commercially available from Bayer Aktiengesellschaft located in Leverkusen, Germany under the BAK® tradename. A specific example of a commercially available polyesteramide is BAK® 404-004.

Specific examples of preferred diacids/diols aliphatic polyesters suitable for use as a biodegradable thermoplastic polymer herein include, but are not limited to, aliphatic polyesters produced either from ring opening reactions or from the condensation polymerization of acids and alcohols, wherein the number average molecular weight of these aliphatic polyesters typically range from about 30,000 g/mol to about 50,000 g/mol. The preferred diacids/diols aliphatic polyesters are reaction products of a $C_2$–$C_{10}$ diol reacted with oxalic acid, succinic acid, adipic acid, suberic acid, sebacic acid, copolymers thereof, or mixtures thereof. Nonlimiting examples of preferred diacids/diols include polyalkylene succinates such as polyethylene succinate, and polybutylene succinate; polyalkylene succinate copolymers such as polyethylene succinate/adipate copolymer, and polybutylene succinate/adipate copolymer; polypentamethyl succinates; polyhexamethyl succinates; polyheptamethyl succinates; polyoctamethyl succinates; polyalkylene oxalates such as polyethylene oxalate, and polybutylene oxalate; polyalkylene oxalate copolymers such as polybutylene oxalate/succinate copolymer and polybutylene oxalate/adipate copolymer; polybutylene oxalate/succinate/adipate terpolyers; and mixtures thereof. An example of a suitable commercially available diacid/diol aliphatic polyester is the polybutylene succinate/adipate copolymers sold as BIONOLLE 1000 series and BIONOLLE 3000 series from the Showa Highpolymer Company, Ltd. Located in Tokyo, Japan.

Specific examples of preferred aliphatic/aromatic copolyesters suitable for use as a biodegradable thermoplastic polymer herein include, but are not limited to, those aliphatic/aromatic copolyesters that are random copolymers formed from a condensation reaction of dicarboxylic acids or derivatives thereof and diols. Suitable dicarboxylic acids include, but are not limited to, malonic, succinic, glutaric, adipic, pimelic, azelaic, sebacic, fumaric, 2,2-dimethyl glutaric, suberic, 1,3-cyclopentanedicarboxylic, 1,4-cyclohexanedicarboxylic, 1,3-cyclohexanedicarboxylic, diglycolic, itaconic, maleic, 2,5-norbornanedicarboxylic, 1,4-terephthalic, 1,3-terephthalic, 2,6-naphthoic, 1,5-naphthoic, ester forming derivatives thereof, and combinations thereof. Suitable diols include, but are not limited to, ethylene glycol, diethylene glycol, triethylene glycol, tetraethylene glycol, propylene glycol, 1,3-propanediol, 2,2-dimethyl-1,3-propanediol, 1,3-butanediol, 1,4-butanediol, 1,5-pentanediol, 1,6-hexanediol, 2,2,4-trimethyl-1,6-hexanediol, thiodiethanol, 1,3-cyclohexanedimethanol, 1,4-cyclohexanedimethanol, 2,2,4,4-tetramethyl-1,3-cyclobutanediol, and combinations thereof. Nonlimiting examples of such aliphatic/aromatic copolyesters include a 50/50 blend of poly(tetramethylene glutarate-co-terephthalate), a 60/40 blend of poly(tetramethylene glutarate-co-terephthalate), a 70/30 blend of poly (tetramethylene glutarate-co-terephthalate), an 85/15 blend of poly(tetramethylene glutarate-co-terephthalate), a 50/45/5 blend of poly(tetramethylene glutarate-co-terephthalate-co-diglycolate), a 70/30 blend of poly (ethylene glutarate-co-terephthalate), an 85/15 blend of poly (tetramethylene adipate-co-terephthalate), an 85/15 blend of poly(tetramethylene succinate-co-terephthalate), a 50/50 blend of poly(tetramethylene-co-ethylene glutarate-co-terephthalate), and a 70/30 blend of poly(tetramethylene-co-ethylene glutarate-co-terephthalate). These aliphatic/aromatic copolyesters, in addition to other suitable aliphatic/aromatic polyesters, are further described in U.S. Pat. No. 5,292,783 issued to Buchanan et al. on Mar. 8, 1994, which descriptions are incorporated by reference herein. An example of a suitable commercially available aliphatic/aromatic copolyester is the poly(tetramethylene adipate-co-terephthalate) sold as EASTAR BIO Copolyester from Eastman Chemical or ECOFLEX from BASF.

Specific examples of preferred lactic acid polymers and lactide polymers suitable for use as a biodegradable thermoplastic polymer herein include, but are not limited to, those polylactic acid-based polymers and polylactide-based polymers that are generally referred to in the industry as "PLA". Therefore, the terms "polylactic acid", "polylactide" and "PLA" are used interchangeably to include homopolymers and copolymers of lactic acid and lactide based on polymer characterization of the polymers being formed from a specific monomer or the polymers being comprised of the smallest repeating monomer units. In other words, polylatide is a dimeric ester of lactic acid and can be formed to contain small repeating monomer units of lactic acid (actually residues of lactic acid) or be manufactured by polymerization of a lactide monomer, resulting in polylatide being referred to both as a lactic acid residue containing polymer and as a lactide residue containing polymer. It should be understood, however, that the terms "polylactic acid", "polylactide", and "PLA" are not intended to be lirniting with respect to the manner in which the polymer is formed.

The polylactic acid polymers generally have a lactic acid residue repeating monomer unit that conforms to the following formula:

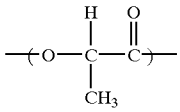

The polylactide polymers generally having lactic acid residue repeating monomer units as described herein-above, or lactide residue repeating monomer units that conform to the following formula:

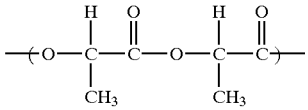

Typically, polymerization of lactic acid and lactide will result in polymers comprising at least about 50% by weight of lactic acid residue repeating units, lactide residue repeating units, or combinations thereof. These lactic acid and lactide polymers include homopolymers and copolymers such as random and/or block copolymers of lactic acid and/or lactide. The lactic acid residue repeating monomer units can be obtained from L-lactic acid and D-lactic acid. The lactide residue repeating monomer units can be obtained from L-lactide, D-lactide, and meso-lactide.

Suitable lactic acid and lactide polymers include those homopolymers and copolymers of lactic acid and/or lactide which have a weight average molecular weight generally ranging from about 10,000 g/mol to about 600,000 g/mol, preferably from about 30,000 g/mol to about 400,000 g/mol, more preferably from about 50,000 g/mol to about 200,000 g/mol. An example of commercially available polylactic acid polymers include a variety of polylactic acids that are available from the Chronopol Incorporation located in Golden, Colo., and the polylactides sold under the tradename EcoPLA®. Examples of suitable commercially available polylactic acid is NATUREWORKS from Cargill Dow and LACEA from Mitsui Chemical. Preferred is a homopolymer or copolymer of poly lactic acid having a melting temperature from about 160° to about 175° C. Modified poly lactic acid and different stero configurations may also be used, such as poly L-lactic acid and poly D,L-lactic acid with D-isomer levels up to 75%.

Depending upon the specific polymer used, the process, and the final use of the fiber, more than one polymer may be desired. It is preferred that two differential polymers are used. For example, if a crystallizable polylactic acid having a melting temperature of from about 160° to about 175° C. is used, a second polylactic acid having a lower melting point and lower crystallinity than the other polylactic acid and/or a higher copolymer level may be used. Alternatively, an aliphatic aromatic polyester may be used with crystallizable polylactic acid. If two polymer are desired, the polymers need only differ by chemical stereo specificity or by molecular weight.

In one aspect of the present invention, it may be desirable to use a biodegradable thermoplastic polymer having a glass transition temperature of less than 0° C. Polymers having this low glass transition temperature include EASTAR BIO and BIONELLE.

The biodegradable thermoplastic polymers of the present invention is present in an amount to improve the mechanical properties of the fiber, improve the processability of the melt, and improve attenuation of the fiber. The selection of the polymer and amount of polymer will also determine if the fiber is thermally bondable and effect the softness and texture of the final product. Typically, biodegradable thermoplastic polymers are present in an amount of from about 1% to about 90%, preferably from about 10% to about 80%, more preferably from about 30% to about 70%, and most preferably from about 40% to about 60%, by weight of the fiber.

Plasticizer

A plasticizer can be used in the present invention to destructurize the starch and enable the starch to flow, i.e. create a thermoplastic starch. The same plasticizer may be used to increase melt processability or two separate plasticizers may be used. The plasticizers may also improve the flexibility of the final products, which is believed to be due to the lowering of the glass transition temperature of the composition by the plasticizer. The plasticizers should preferably be substantially compatible with the polymeric components of the present invention so that the plasticizers may effectively modify the properties of the composition. As used herein, the term "substantially compatible" means when heated to a temperature above the softening and/or the melting temperature of the composition, the plasticizer is capable of forming a substantially homogeneous mixture with starch.

An additional plasticizer or diluent for the biodegradable thermoplastic polymer may be present to lower the polymer's melting temperature and improve overall compatibility with the thermoplastic starch blend. Furthermore, biodegradable thermoplastic polymers with higher melting temperatures may be used if plasticizers or diluents are present which suppress the melting temperature of the polymer. The plasticizer will typically have a molecular weight of less than about 100,000 g/mol and may preferably be a block or random copolymer or terpolymer where one or more of the chemical species is compatible with another plasticizer, starch, polymer, or combinations thereof.

Nonlimiting examples of useful hydroxyl plasticizers include sugars such as glucose, sucrose, fructose, raffinose, maltodextrose, galactose, xylose, maltose, lactose, mannose erythrose, glycerol, and pentaerythritol; sugar alcohols such as erythritol, xylitol, malitol, mannitol and sorbitol; polyols such as ethylene glycol, propylene glycol, dipropylene glycol, butylene glycol, hexane triol, and the like, and polymers thereof; and mixtures thereof. Also useful herein as hydroxyl plasticizers are poloxomers and poloxamines. Also suitable for use herein are hydrogen bond forming organic compounds which do not have hydroxyl group, including urea and urea derivatives; anhydrides of sugar alcohols such as sorbitan; animal proteins such as gelatin; vegetable proteins such as sunflower protein, soybean proteins, cotton seed proteins; and mixtures thereof. Other suitable plasticizers are phthalate esters, dimethyl and diethylsuccinate and related esters, glycerol triacetate, glycerol mono and diacetates, glycerol mono, di, and triprpionates, butanoates, stearates, lactic acid esters, citric acid esters, adipic acid esters, stearic acid esters, oleic acid esters, and other father acid esters which are biodegradable. Aliphatic acids such as ethylene acrylic acid, ethylene maleic acid, butadiene acrylic acid, butadiene maleic acid, propylene acrylic acid, propylene maleic acid, and other hydrocarbon based acids. All of the plasticizers may be use alone or in mixtures thereof. A low molecular weight plasticizer is preferred. Suitable molecular weights are less than about 20,000 g/mol, preferably less than about 5,000 g/mol and more preferably less than about 1,000 g/mol.

Preferred plasticizers include glycerine, mannitol, and sorbitol. The amount of plasticizer is dependent upon the molecular weight and amount of starch and the affinity of the plasticizer for the starch. Generally, the amount of plasticizer increases with increasing molecular weight of starch. Typically, the plasticizer present in the final fiber composition comprises from about 2% to about 70%, more preferably from about 5% to about 55%, most preferably from about 10% to about 50%.

Optional Materials

Optionally, other ingredients may be incorporated into the spinnable starch composition. These optional ingredients may be present in quantities of less than about 50%, preferably from about 0.1% to about 20%, and more preferably from about 0.1% to about 12% by weight of the composition. The optional materials may be used to modify the processability and/or to modify physical properties such as elasticity, tensile strength and modulus of the final product. Other benefits include, but are not limited to, stability including oxidative stability, brightness, color, flexibility, resiliency, workability, processing aids, viscosity modifiers, and odor control. Nonlimiting examples include salts, slip agents, crystallization accelerators or retarders, odor masking agents, cross-linking agents, emulsifiers, surfactants, cyclodextrins, lubricants, other processing aids, optical brighteners, antioxidants, flame retardants, dyes, pigments, fillers, proteins and their alkali salts, waxes, tackifying resins, extenders, and mixtures thereof. Slip agents may be used to help reduce the tackiness or coefficient of friction in the fiber. Also, slip agents may be used to improve fiber stability, particularly in high humidity or temperatures. A suitable slip agent is polyethylene. A salt may also be added to the melt. The salt may help to solubilize the starch, reduce discoloration, make the fiber more water responsive, or used as a processing aid. A salt will also function to help reduce the solubility of a binder so it does not dissolve, but when put in water or flushed, the salt will dissolve then enabling the binder to dissolve and create a more aqueous responsive product. Nonlimiting examples of salts include sodium chloride, potassium chloride, sodium sulfate, ammonium sulfate and mixtures thereof.

Other additives are typically included with the starch polymer as a processing aid and to modify physical properties such as elasticity, dry tensile strength, and wet strength of the extruded fibers. Suitable extenders for use herein include gelatin, vegetable proteins such as sunflower protein, soybean proteins, cotton seed proteins, and water soluble polysaccharides; such as alginates, carrageenans, guar gum, agar, gum arabic and related gums, pectin, water soluble derivatives of cellulose, such as alkylcelluloses, hydroxyalkylcelluloses, and carboxymethylcellulose. Also, water soluble synthetic polymers, such as polyacrylic acids, polyacrylic acid esters, polyvinylacetates, polyvinylalcohols, and polyvinylpyrrolidone, may be used.

Lubricant compounds may further be added to improve the flow properties of the starch material during the processes used for producing the present invention. The lubricant compounds can include animal or vegetable fats, preferably in their hydrogenated form, especially those which are solid at room temperature. Additional lubricant materials include mono-glycerides and di-glycerides and phosphatides, especially lecithin. For the present invention, a preferred lubricant compound includes the monoglyceride, glycerol mono-stearate.

Further additives including inorganic fillers such as the oxides of magnesium, aluminum, silicon, and titanium may be added as inexpensive fillers or processing aides. Other inorganic materials include hydrous magnesium silicate, titanium dioxide, calcium carbonate, clay, chalk, boron nitride, limestone, diatomaceous earth, mica glass quartz, and ceramics. Additionally, inorganic salts, including alkali metal salts, alkaline earth metal salts, phosphate salts, may be used as processing aides. Other optional materials that modify the water responsiveness of the thermoplastic starch blend fiber are stearate based salts, such as sodium, magnesium, calcium, and other stearates and rosin components including anchor gum rosin. Another material that can be added is a chemical composition formulated to further accelerate the environmental degradation process such as colbalt stearate, citric acid, calcium oxide, and other chemical compositions found in U.S. Pat. No. 5,854,304 to Garcia et al., herein incorporated by reference in its entirety.

Other additives may be desirable depending upon the particular end use of the product contemplated. For example, in products such as toilet tissue, disposable towels, facial tissues and other similar products, wet strength is a desirable attribute. Thus, it is often desirable to add to the starch polymer cross-linking agents known in the art as "wet strength" resins. A general dissertation on the types of wet strength resins utilized in the paper art can be found in TAPPI monograph series No. 29, Wet Strength in Paper and Paperboard, Technical Association of the Pulp and Paper Industry (New York, 1965). The most useful wet strength resins have generally been cationic in character. Polyamide-epichlorohydrin resins are cationic polyamide amine-epichlorohydrin wet strength resins which have been found to be of particular utility. Glyoxylated polyacrylamide resins have also been found to be of utility as wet strength resins.

It is found that when suitable cross-linking agent such as Parez® is added to the starch composition of the present invention under acidic condition, the composition is rendered water insoluble. Still other water-soluble cationic resins finding utility in this invention are urea formaldehyde and melamine formaldehyde resins. The more common functional groups of these polyfunctional resins are nitrogen containing groups such as amino groups and methyl groups attached to nitrogen. Polyethylenimine type resins may also find utility in the present invention. For the present invention, a suitable cross-linking agent is added to the composition in quantities ranging from about 0.1% by weight to about 10% by weight, more preferably from about 0.1% by weight to about 3% by weight. The starch and polymers in the fibers of the present invention may be chemically associated. The chemical association may be a natural consequence of the polymer chemistry or may be engineered by selection of particular materials. This is most likely to occur if a cross-linking agent is present. The chemical association may be observed by changes in molecular weight, NMR signals, or other methods known in the art. Advantages of chemical association include improved water sensitivity, reduced tackiness, and improved mechanical properties, among others.

Other polymers, such as non-degradable polymers, may also be used in the present invention depending upon final use of the fiber, processing, and degradation or flushability required. Commonly used thermoplastic polymers include polypropylene and copolymers of polypropylene, polyethylene and copolymers of polyethylene, polyamides and copolymers of polyamides, polyesters and copolymers of polyesters, and mixtures thereof. The amount of non-degradable polymers will be from about 0.1% to about 40% by weight of the fiber. Other polymers such as high molecular weight polymers with molecular weights above 500,000 g/mol may also be used.

Although starch is the preferred natural polymer in the present invention, a protein-based polymer could also be used. Suitable protein-based polymers include soy protein, zein protein, and combinations thereof. The protein-based polymer may be present in an amount of from about 0.1% to about 80% and preferably from about 1% to about 60%.

After the fiber is formed, the fiber may further be treated or the bonded fabric can be treated. A hydrophilic or hydrophobic finish can be added to adjust the surface energy and chemical nature of the fabric. For example, fibers that are hydrophobic may be treated with wetting agents to facilitate absorption of aqueous liquids. A bonded fabric can also be treated with a topical solution containing surfactants, pigments, slip agents, salt, or other materials to further adjust the surface properties of the fiber.

(2) Configuration

The multiconstituent fibers of the present invention may be in many different configurations. Constituent, as used herein, is defined as meaning the chemical species of matter or the material. Fibers may be of monocomponent or multicomponent in configuration. Component, as used herein, is defined as a separate part of the fiber that has a spatial relationship to another part of the fiber.

Spunbond structures, staple fibers, hollow fibers, shaped fibers, such as multi-lobal fibers and multicomponent fibers can all be produced by using the compositions and methods of the present invention. Multicomponent fibers, commonly a bicomponent fiber, may be in a side-by-side, sheath-core, segmented pie, ribbon, or islands-in-the-sea configuration. The sheath may be continuous or non-continuous around the core. The ratio of the weight of the sheath to the core is from about 5:95 to about 95:5. The fibers of the present invention may have different geometries that include round, elliptical, star shaped, rectangular, and other various eccentricities. The fibers of the present invention may also be splittable fibers. Splitting may occur by rheological differences in the polymers or splitting may occur by a mechanical means and/or by fluid induced distortion.

For a bicomponent, the starch/polymer composition of the present invention may be both the sheath and the core with one of the components containing more starch or polymer than the other component. Alternatively, the starch/polymer composition of the present invention may be the sheath with the core being pure polymer or starch. The starch/polymer composition could also be the core with the sheath being pure polymer or starch. The exact configuration of the fiber desired is dependent upon the use of the fiber.

A plurality of microfibrils may also result from the present invention. The microfibrils are very fine fibers contained within a multi-constituent monocomponent or multicomponent extrudate. The plurality of polymer microfibrils have a cable-like morphological structure and longitudinally extend within the fiber, which is along the fiber axis. The microfibrils may be continuous or discontinuous. To enable the microfibrils to be formed in the present invention, a sufficient amount of polymer is required to generate a co-continuous phase morphology such that the polymer microfibrils are formed in the starch matrix. Typically, greater than 15%, preferably from about 15% to about 90%, more preferably from about 25% to about 80%, and more preferably from about 35% to about 70% of polymer is desired. A "co-continuous phase morphology" is found when the microfibrils are substantially longer than the diameter of the fiber. Microfibrils are typically from about 0.1 micrometers to about 10 micrometers in diameter while the fiber typically has a diameter of from about (10 times the microfibril) 10 micrometers to about 50 micrometers. In addition to the amount of polymer, the molecular weight of the thermoplastic polymer must be high enough to induce sufficient entanglement to form microfibrils. The preferred molecular weight is from about 10,000 to about 500,000 g/mol. The formation of the microfibrils also demonstrates that the resulting fiber is not homogeneous, but rather that polymer microfibrils are formed within the starch matrix. The microfibrils comprised of the biodegradable polymer will mechanically reinforce the fiber to improve the overall tensile strength and make the fiber thermally bondable.

FIG. 1 is a cross-sectional perspective view of a highly attenuated fiber 10 containing a multiplicity of microfibrils 12. The biodegradable thermoplastic polymer microfibrils 12 are contained within the starch matrix 14 of the fiber 10.

Alternatively, microfibrils can be obtained by co-spinning starch and polymer melt without phase mixing, as in an islands-in-a-sea bicomponent configuration. In an islands-in-a-sea configuration, there may be several hundred fine fibers present.

The monocomponent fiber containing the microfibrils can be used as a typical fiber or the starch can be removed to only use the microfibrils. The starch can be removed through bonding methods, hydrodynamic entanglement, post-treatment such as mechanical deformation, or dissolving in water. The microfibrils may be used in nonwoven articles that are desired to be extra soft and/or have better barrier properties.

(3) Material Properties

The fibers produced in the present invention are environmentally degradable. "Environmentally degradable" is defined as being biodegradable, disintigratable, dispersible, flushable, or compostable or a combination thereof. In the present invention, the fibers, nonwoven webs, and articles will be environmentally degradable. As a result, the fibers can be easily and safely disposed of either in existing composting facilities or may be flushable and can be safely flushed down the drain without detrimental consequences to existing sewage infrastructure systems. The environmental degradability of the fibers of the present inventions offer a solution to the problem of accumulation of such materials in the environment following their use in disposable articles. The flushability of the fibers of the present invention when used in disposable products, such as wipes and feminine hygiene items, offer additional convenience and discreteness to the consumer. Although biodegradability, disintegratability, dispersibility, compostibility, and flushability all have different criteria and are measured through different tests, generally the fibers of the present invention will meet more than one of these criteria.

Biodegradable is defined as meaning when the matter is exposed to an aerobic and/or anaerobic environment, the ultimate fate is reduction to monomeric components due to microbial, hydrolytic, and/or chemical actions. Under aerobic conditions, biodegradation leads to the transformation of the material into end products such as carbon dioxide and water. Under anaerobic conditions, biodegradation leads to the transformation of the materials into carbon dioxide, water, and methane. The biodegradability process is often described as mineralization. Biodegradability means that all organic constituents of the fibers are subject to decomposition eventually through biological activity.

There are a variety of different standardized biodegradability methods that have been established over time by various organization and in different countries. Although the tests vary in the specific testing conditions, assessment methods, and criteria desired, there is reasonable convergence between different protocols so that they are likely to lead to similar conclusions for most materials. For aerobic biodegrability, the American Society for Testing and Materials (ASTM) has established ASTM D 5338-92: Test methods for Determining Aerobic Biodegradation of Plastic Materials Under Controlled Composting Conditions. The test measures the percent of test material that mineralizes as a function of time by monitoring the amount of carbon dioxide being released as a result of assimilation by microorganisms in the presence of active compost held at a thermophilic temperature of 58° C. Carbon dioxide production testing may be conducted via electrolytic respirometry. Other standard protocols, such 301B from the Organization for Economic Cooperation and Development (OECD), may also be used. Standard biodegradation tests in the absence of oxygen are described in various protocols such as ASTM D 5511-94. These tests are used to simulate the biodegradability of materials in an anaerobic solid-waste treatment facility or sanitary landfill. However, these conditions are less relevant for the type of disposable applications that are described for the fibers and nonwovens in the present invention.

The fibers of the present invention will likely rapidly biodegrade. Quantitatively, this is defined in terms of percent of material converted to carbon dioxide after a given amount of time. The fibers of the present invention containing x % starch and y % biodegradable thermoplastic polymer, and optionally other ingredients, will aerobically biodegrade under standard conditions such that fibers exhibit: x/2% conversion to carbon dioxide in less than 10 days and (x+y)/2% conversion to carbon dioxide in less than 60 days. Disintegration occurs when the fibrous substrate has the ability to rapidly fragment and break down into fractions small enough not to be distinguishable after screening when composted or to cause drainpipe clogging when flushed. A disintegratable material will also be flushable. Most protocols for disintegratability measure the weight loss of test materials over time when exposed to various matrices. Both aerobic and anaerobic disintegration tests are used. Weight loss is determined by the amount of fibrous test material that is no longer collected on an 18 mesh sieve with 1 millimeter openings after the materials is exposed to wastewater and sludge. For disintegration, the difference in the weight of the initial sample and the dried weight of the sample recovered on a screen will determine the rate and extent of disintegration. The testing for biodegradability and disintegration are similar as a very similar environment, or the same environment, will be used for testing. To determine disintegration, the weight of the material remaining is measured while for biodegradability, the evolved gases are measured.

The fibers of the present invention will rapidly disintegrate. Quantitatively, this is defined in terms of relative weight loss of each component after a given amount of time. The fibers of the present invention containing x % starch and y % biodegradable thermoplastic polymer, and optionally other ingredients, will aerobically disintegrate when exposed to activated sludge in the presence of oxygen under standard conditions such that fibers exhibit: x/2% weight loss in less than 10 days and (x+y)/2% weight loss in less than 60 days. Preferably, the fibers will exhibit x/2% weight loss in less than 5 days and (x+y)/2% weight loss in less than 28 days, more preferably x/2% weight loss in less than 3 days and (x+y)/2% weight loss in less than 21 days, even more preferably (x/1.5)% weight loss in less than 5 days and (x+y)/1.5% weight loss in less than 21 days, and most preferably x/1.2% weight loss in less than 5 days and (x+y)/1.2% weight loss in less than 21 days.

The fibers of the present invention will also be compostable. ASTM has developed test methods and specifications for compostibility. The test measures three characteristics: biodegradability, disintegration, and lack of ecotoxicity. Tests to measure biodegradability and disintegration are described above. To meet the biodegradability criteria for compostability, the material must achieve at least about 60% conversion to carbon dioxide within 40 days. For the disintegration criteria, the material must have less than 10% of the test material remain on a 2 millimeter screen in the actual shape and thickness that it would have in the disposed product. To determine the last criteria, lack of ecotoxicity, the biodegradation byproducts must not exhibit a negative impact on seed germination and plant growth. One test for this criteria is detailed in OECD 208. The International Biodegradable Products Institute will issue a logo for compostability once a product is verified to meet ASTM 6400-99 specifications. The protocol follows Germany's DIN 54900 which determine the maximum thickness of any material that allows complete decomposition within one composting cycle.

The fibers described herein are typically used to make disposable nonwoven articles. The articles are commonly flushable. The term "flushable" as used herein refers to materials which are capable of dissolving, dispersing, disintegrating, and/or decomposing in a septic disposal system such as a toilet to provide clearance when flushed down the toilet without clogging the toilet or any other sewage drainage pipe. The fibers and resulting articles may also be aqueous responsive. The term aqueous responsive as used herein means that when placed in water or flushed, an observable and measurable change will result. Typical observations include noting that the article swells, pulls apart, dissolves, or observing a general weakened structure.

The tensile strength of a starch fiber is approximately 15 Mega Pascal (MPa). The fibers of the present invention will have a tensile strength of greater than about 20 MPa, preferably greater than about 35 MPa, and more preferably greater than about 50 MPa. Tensile strength is measured using an Instron following a procedure described by ASTM standard D 3822-91 or an equivalent test.

The fibers of the present invention are not brittle and have a toughness of greater than 2 MPa. Toughness is defined as the area under the stress-strain curve where the specimen gauge length is 25 mm with a strain rate of 50 mm per minute. Elasticity or extensible of the fibers may also be desired.

The fibers of the present invention may be thermally bondable if enough polymer is present in the monocomponent fiber or in the outside component of a multicomponent fiber (i.e. the sheath of a bicomponent). Thermally bondable fibers are required for the pressurized heat and thru-air heat bonding methods. Thermally bondable is typically achieved when the polymer is present at a level of greater than about 15%, preferably greater than about 30%, most preferably greater than about 40%, and most preferably greater than about 50% by weight of the fiber. Consequently, if a very high starch content is in the monocomponent or in the sheath, the fiber may exhibit a decreased tendency toward thermal bondablility.

A "highly attenuated fiber" is defined as a fiber having a high draw down ratio. The total fiber draw down ratio is defined as the ratio of the fiber at its maximum diameter (which is typically results immediately after exiting the capillary) to the final fiber diameter in its end use. The total fiber draw down ratio via either staple, spunbond, or melt-blown process will be greater than 1.5, preferable greater than 5, more preferably greater than 10, and most preferably greater than 12. This is necessary to achieve the tactile properties and useful mechanical properties.

Preferably, the highly attenuated fiber will have a diameter of less than 200 micrometers. More preferably the fiber diameter will be 100 micrometer or less, even more preferably 50 micrometers or less, and most preferably less than 30 micrometers. Fibers commonly used to make nonwovens will have a diameter of from about 5 micrometers to about 30 micrometers. Fiber diameter is controlled by spinning speed, mass through-put, and blend composition.

The nonwoven products produced from the fibers will also exhibit certain mechanical properties, particularly, strength, flexibility, softness, and absorbency. Measures of strength include dry and/or wet tensile strength. Flexibility is related to stiffness and can attribute to softness. Softness is generally described as a physiologically perceived attribute which is related to both flexibility and texture. Absorbency relates to the products' ability to take up fluids as well as the capacity to retain them.

(4) Processes

The first step in producing a fiber is the compounding or mixing step. In the compounding step, the raw materials are heated, typically under shear. The shearing in the presence of heat will result in a homogeneous melt with proper selection of the composition. The melt is then placed in an extruder where fibers are formed. A collection of fibers is combined together using heat, pressure, chemical binder, mechanical entanglement, and combinations thereof resulting in the formation of a nonwoven web. The nonwoven is then assembled into an article.

Compounding

The objective of the compounding step is to produce a homogeneous melt composition comprising the starch, polymer, and plasticizer. Preferably, the melt composition is homogeneous, meaning that a uniform distribution is found over a large scale and that no distinct regions are observed.

The resultant melt composition should be essentially free of water to spin fibers. Essentially free is defined as not creating substantial problems, such as causing bubbles to form which may ultimately break the fiber while spinning. Preferably, the free water content of the melt composition is less than about 1%, more preferably less than about 0.5%, and most preferably less than 0.1%. The total water content includes the bound and free water. To achieve this low water content, the starch and polymers may need to be dried before processing and/or a vacuum is applied during processing to remove any free water. Preferably, the thermoplastic starch is dried at 60° C. before spinning.

In general, any method using heat, mixing, and pressure can be used to combine the biodegradable polymer, starch, and plasticizer. The particular order or mixing, temperatures, mixing speeds or time, and equipment are not critical as long as the starch does not significantly degrade and the resulting melt is homogeneous.

A method of mixing for a starch and two polymer blend is as follow:

1. The polymer having a higher melting temperature is heated and mixed above its melting point. Typically, this is 30°–70° C. above its melting temperature. The mixing time is from about 2 to about 10 minutes, preferably around 5 minutes. The polymer is then cooled, typically to 120°–140° C.
2. The starch is fully destructurized. This starch can be destructurized by dissolving in water at 70°–100° C. at a concentration of 10–90% starch depending upon the molecular weight of the starch, the desired viscosity of the destructurized starch, and the time allowed for destructurizing. In general, approximately 15 minutes is sufficient to destructurize the starch but 10 minutes to 30 minutes may be necessary depending upon conditions. A plasticizer can be added to the destructurized starch if desired.

3. The cooled polymer from step 1 and the destructurized starch from step 2 are then combined. The polymer and starch can be combined in an extruder or a batch mixer with shear. The mixture is heated, typically to approximately 120°–140° C. This results in vaporization of any water. If desired to flash off all water, the mixture should be mixed until all of the water is gone. Typically, the mixing in this step is from about 2 to about 15 minutes, typically it is for approximately 5 minutes. A homogenous blend of starch and polymer is formed.
4. A second polymer is then added to the homogeneous blend of step 3. This second polymer may be added at room temperature or after it has been melted and mixed. The homogeneous blend from step 3 is continued to be mixed at temperatures from about 100° C. to about 170° C. The temperatures above 100° C. are needed to prevent any moisture from forming. If not added in step 2, the plasticizer may be added now. The blend is continued to be mixed until it is homogeneous. This is observed by noting no distinct regions. Mixing time is generally from about 2 to about 10 minutes, commonly around 5 minutes.

Another method of mixing for a starch and plasticizer blend is as follows:

1. The starch is destructured by addition of a plasticizer. The plasticizer, if solid such as sorbitol or mannitol, can be added with starch (in powder form) into a twin-screw extruder. Liquids such as glycerine, can be combined with the starch via volumetric displacement pumps.
2. The starch is fully destructurized by application of heat and shear in the extruder. The starch and plasticizer mixture is typically heated to 120–180° C. over a period of from about 10 seconds to about 15 minutes, until the starch gelatinizes.
3. A vacuum can applied to the melt in the extruder, typically at least once, to remove free water. Vacuum can be applied, for example, approximately two-thirds of the way down the extruder length, or at any other point desired by the operator.
4. Alternatively, multiple feed zones can be used for introducing multiple plasticizers or blends of starch.
5. Alternatively, the starch can be premixed with a liquid plasticizer and pumped into the extruder.

As will be appreciated by one skilled in the art of compounding, numerous variations and alternate methods and conditions can be used for destructuring the starch and formation of the starch melt including, without limitation, via feed port location and screw extruder profile.

A suitable mixing device is a multiple mixing zone twin screw extruder with multiple injection points. The multiple injection points can be used to add the destructurized starch and polymer. A twin screw batch mixer or a single screw extrusion system can also be used. As long as sufficient mixing and heating occurs, the particular equipment used is not critical.

An alternative method for compounding the materials is by adding the plasticizer, starch, and polymer to an extrusion system where they are mixed in progressively increasing temperatures. For example, in a twin screw extruder with six heating zones, the first three zones may be heated to 90°, 120°, and 130° C., and the last three zones will be heated above the melting point of the polymer. This procedure results in minimal thermal degradation of the starch and for the starch to be fully destructured before intimate mixing with the thermoplastic materials.

Another process is to use a higher temperature melting polymer and inject the starch at the very end of the process. The starch is only at a higher temperature for a very short amount of time which is not enough time to burn.

An example of compounding destructured thermoplastic starch would be to use a Werner & Pfleiderer (30 mm diameter 40:1 length to diameter ratio) co-rotating twin-screw extruder set at 250 RPM with the first two heat zones set at 50° C. and the remaining five heating zones set 150° C. A vacuum is attached between the penultimate and last heat section pulling a vacuum of 10 atm. Starch powder and plasticizer (e.g., sorbitol) are individually fed into the feed throat at the base of the extruder, for example using mass-loss feeders, at a combined rate of 30 lbs/hour (13.6 kg/hour) at a 60/40 weight ratio of starch/plasticizer. Processing aids can be added along with the starch or plasticizer. For example, magnesium separate can be added, for example, at a level of 0–1%, by weight, of the thermoplastic starch component.

Spinning

The present invention utilizes the process of melt spinning. In melt spinning, there is no mass loss in the extrudate. Melt spinning is differentiated from other spinning, such as wet or dry spinning from solution, where a solvent is being eliminated by volatilizing or diffusing out of the extrudate resulting in a mass loss.

Spinning will occur at 120° C. to about 230°, preferably 185° to about 190°. Fiber spinning speeds of greater than 100 meters/minute are required. Preferably, the fiber spinning speed is from about 1,000 to about 10,000 meters/minute, more preferably from about 2,000 to about 7,000 meters/minute, and most preferably from about 2,500 to about 5,000 meters/minute. The polymer composition must be spun fast to avoid brittleness in the fiber.

Continuous fibers can be produced through spunbond methods or meltblowing processes or non-continuous (staple fibers) fibers can be produced. The various methods of fiber manufacturing can also be combined to produce a combination technique.

The homogeneous blend can be melt spun into fibers on conventional melt spinning equipment. The temperature for spinning range from about 100° C. to about 230° C. The processing temperature is determined by the chemical nature, molecular weights and concentration of each component. The fibers spun can be collected using conventional godet winding systems or through air drag attenuation devices. If the godet system is used, the fibers can be further oriented through post extrusion drawing at temperatures from about 50 to about 140° C. The drawn fibers may then be crimped and/or cut to form non-continuous fibers (staple fibers) used in a carding, airlaid, or fluidlaid process.

For example, a suitable process for spinning thermoplastic starch fibers. The destructured starch component extruder profile may be 80° C., 180° C. and 180° C. in the first three zones of a three heater zone extruder with a starch composition similar to Example 9. The transfer lines and melt pump heater temperatures may be 180° C. for the starch component. In this case the spinneret temperature can range from 180° C. to 230° C.

In the process of spinning fibers, particularly as the temperature is increased above 105° C., typically it is desirable for residual water levels to be 1%, by weight of the fiber, or less, alternately 0.5% or less, or 0.15% or less.

(5) Articles

The fibers may be converted to nonwovens by different bonding methods. Continuous fibers can be formed into a web using industry standard spunbond type technologies while staple fibers can be formed into a web using industry standard carding, airlaid, or wetlaid technologies. Typical bonding methods include: calendar (pressure and heat), thru-air heat, mechanical entanglement, hydrodynamic entanglement, needle punching, and chemical bonding and/or resin bonding. The calendar, thru-air heat, and chemical bonding are the preferred bonding methods for the starch polymer fibers. Thermally bondable fibers are required for the pressurized heat and thru-air heat bonding methods.

The fibers of the present invention may also be bonded or combined with other synthetic or natural fibers to make nonwoven articles. The synthetic or natural fibers may be blended together in the forming process or used in discrete layers. Suitable synthetic fibers include fibers made from polypropylene, polyethylene, polyester, polyacrylates, and copolymers thereof and mixtures thereof. Natural fibers include cellulosic fibers and derivatives thereof. Suitable cellulosic fibers include those derived from any tree or vegetation, including hardwood fibers, softwood fibers, hemp, and cotton. Also included are fibers made from processed natural cellulosic resources such as rayon.

The fibers of the present invention may be used to make nonwovens, among other suitable articles. Nonwoven articles are defined as articles that contains greater than 15% of a plurality of fibers that are continuous or non-continuous and physically and/or chemically attached to one another. The nonwoven may be combined with additional nonwovens or films to produce a layered product used either by itself or as a component in a complex combination of other materials, such as a baby diaper or feminine care pad. Preferred articles are disposable, nonwoven articles. The resultant products may find use in filters for air, oil and water; vacuum cleaner filters; furnace filters; face masks; coffee filters, tea or coffee bags; thermal insulation materials and sound insulation materials; nonwovens for one-time use sanitary products such as diapers, feminine pads, and incontinence articles; biodegradable textile fabrics for improved moisture absorption and softness of wear such as micro fiber or breathable fabrics; an electrostatically charged, structured web for collecting and removing dust; reinforcements and webs for hard grades of paper, such as wrapping paper, writing paper, newsprint, corrugated paper board, and webs for tissue grades of paper such as toilet paper, paper towel, napkins and facial tissue; medical uses such as surgical drapes, wound dressing, bandages, dermal patches and self-dissolving sutures; and dental uses such as dental floss and toothbrush bristles. The fibrous web may also include odor absorbents, termite repellants, insecticides, rodenticides, and the like, for specific uses. The resultant product absorbs water and oil and may find use in oil or water spill clean-up, or controlled water retention and release for agricultural or horticultural applications. The resultant starch fibers or fiber webs may also be incorporated into other materials such as saw dust, wood pulp, plastics, and concrete, to form composite materials, which can be used as building materials such as walls, support beams, pressed boards, dry walls and backings, and ceiling tiles; other medical uses such as casts, splints, and tongue depressors; and in fireplace logs for decorative and/or burning purpose. Preferred articles of the present invention include disposable nonwovens for hygiene and medical applications. Hygiene applications include such items as wipes; diapers, particularly the top sheet or back sheet; and feminine pads or products, particularly the top sheet.

EXAMPLES

The Examples below further illustrate the present invention. The starches used in the examples below are StarDri 100, StaDex 10, StaDex 15, StaDex 65, all from Staley. The crystalline PLA has an intrinsic viscosity of 0.97 dL/g with an optical rotation of −14.2. The amorphous PLA has an intrinsic viscosity of 1.09 dL/g with an optical rotation of −12.7. The poly(3-hydroxybutyrate co-alkanoate), PHA, has a molecular weight of 1,000,00 g/mol before compounding. The polyhydroxybutyrate (PHB) was purchased from Goodfellow as BU 396010. The polyvinyl alcohol copolymer (PVOH) was purchased from Air Products Inc. and is a 2000 series polymer.

Comparative Example 1

The following example would yield properties typical for a thermoplastic starch blend. The blend contains 60 parts StarDri 100, 38 parts water and 2 parts glycerin. The blend is mixed in an extruder at 90° C. for 5 minutes and then can be melt spun into fibers at 90° C. The blend and fibers are homogenous with fully destructured starch. Typical fiber properties for these fibers would be 15.8 MPa peak tensile strength and 3.2% elongation at break. These starch fibers are not suitable for future use due to the low peak tensile strength.

Comparative Example 2

This example is to illustrate the importance in destructurizing the starch. The blend consisted of adding 30 parts amorphous PLA and 30 parts StarDri 100 with 3 parts glycerin. All three components are mixed together and added to the mixer at 80° C. The mixture is then sheared and raised to 150° C. and then 180° C. in 3 minute intervals. When removed from the mixer, the blend looks mixed, but with small granules. The blend was then placed in a piston type of extruder with a heated jacket. A single hole spinneret was used to extrude the molten blend through. The fibers could then be collected using a godet type winder with sleeves, using a rheostat to control the radial velocity. Alternatively, a pressure induced draw device common in the synthetic nonwoven spinning industry could be used to attenuate the filament.

The spinning of this blend was conducted at 180° C. after a hold time of 10 minutes to allow the polymer blend to heat properly and uniformly. The blend was then extruded at 1.0 g/min and fibers were collected through the air draw device. The fibers were soft with a very small diameter.

Upon cleaning the system for the next run, it was noted that the residue contained an extremely granular looking substance, similar to the original starch compound. It appeared at this time like the filter protecting the spinneret had collected most of the starch, meaning that mostly the PLA had been extruded, although the exact amount is not known.

Comparative Example 3

In light of the findings in Comparative Example 2, a different method for compounding the blend was utilized. In this case, a 50/50 solution of starch in water at 90° C. was used. The starch was allowed to soak in the water until fully dissolved and the solution was clear. This starch solution was then mixed in an amount equivalent to 75 parts solid StarDri 100, along with 25 parts amorphous PLA and 10 parts glycerin. It was noted that this blend did not exhibit any granular structure consistent with starch that has been fully destructured.

The blend appeared to spin at 170° C. and throughput of 1.0 g/min with little to no problems. The fibers appeared to be weak and brittle. This example exemplifies the poor mechanical properties resulting from PLA that does not crystallize.

Example 4

In light of the findings in Comparative Example 3 and the weakness of these fibers, a different blend composition for compounding was utilized. A 50/50 solution of starch in water at 90° C. was used. The starch was allowed to soak in the water until fully dissolved and the solution was clear. This starch solution was mixed in an amount equivalent to 50 parts solid StarDri 100, along with 12 parts amorphous PLA, 37 parts semi crystalline PLA and 10 parts glycerin. It was noted that this blend did not exhibit any granular structure consistent with starch that has not been fully destructured. The blend was compounded as follows: the high melting temperature semi-crystalline PLA (Tm≈170° C.) was added to the twin-screw mixer at 210° C. for 5 minutes until completely mixed. The temperature was then decreased to 130° C., at which time the starch solution and glycerin was added and the water vapor flashed off. Once the vapor was flashed off, the amorphous PLA was added and the mixture blended for 5 minutes.

The blend appeared to spin very well spin at 180° C. and throughput of 1.0 g/min with little to no problems. The fibers appeared to be weak and brittle at large fiber diameters or low spinning speeds. However, at small diameters and high spinning speeds, the fibers were soft, strong and exhibited some extensional behavior. The leftover polymer in the extrusion system was visually inspected with no noticeable starch grains.

This process of addition points out the importance of adding the starch in a fully destructured state and that when PLA crystallizes, it can make significant mechanical property improvements over amorphous PLA in a blend. Example 4a is for the large diameter fibers having a diameter of 410 micrometers and a draw down ratio of 1 and Example 4b is for the small diameter fibers having a diameter of 23 micrometers and a draw down ratio of about 20.

Example 5

The blend was compounded as in example 3 with 74 parts amorphous PLA, 24 parts StarDri 100 and 6 parts glycerine. The properties are in Table 1.

Example 6

The blend was compounded as in example 3 with 27 parts PLA, 64 parts StarDri 100 and 9 parts glycerine. The properties are in Table 1.

Example 7

The blend was compounded as in example 3 with 45 parts Eastar Bio, 45 parts StarDri 100 and 10 parts glycerine. The properties are in Table 1.

Example 8

The blend was compounded as in example 3 with 45 parts Bionolle 1020, 45 parts StarDri 100 and 10 parts glycerine. The properties are in Table 1.

Example 9

The blend was compounded as in example 3 with 23 parts amorphous PLA, 24 parts PLA, 45 parts StarDri 100 and 10 parts glycerine. The properties are in Table 1.

Example 10

Disintegration testing of fibers produced in example 9 is detailed below. Aerobic Disintegration testing: Samples were placed in 1 liter bottles containing 800 ml of raw wastewater. A rotary platform shaker set at 100 rpm and three small aquarium pumps were used for constant agitation and aeration of the wastewater and samples. On days 3, 7, 10, 14, 21 and 28, one bottle each was poured through an 18 mesh sieve (1 mm openings) and the sample retained on the screen was rinsed, dried and weighed to determine percent weight loss.

Slightly less than 2 grams of the fibers were received in one large clump. This was divided into 6 clumps of approximately 300 mg each. The fibers were dried overnight at 40° C., then cooled and weighed before placing in the six bottles. Influent wastewater was poured through an 18 mesh sieve before dispensing to the 1 liter glass bottles.

The samples were incubated in biologically active wastewater, but since evolved gases are not measured, the result is expressed as percent disintegration not biodegradation. The rate and extent of disintegration is determined by the difference in weight of the initial sample and the dried weight of the sample recovered on a screen with 1 mm openings. Because the fibers were thin, pieces may have passed through the 1 mm mesh openings without extensive disintegration. The rate and extent of disintegration for each of the sampling time points are summarized in the following table.

Average percent weight loss over time and visual description of recovered residue:

| Sample Day | % weight loss (<1 mm mesh) | Visual observation of fibers remaining on the No. 18 Sieve |
|---|---|---|
| 3 | 75% | The clump of fibers appears mostly intact with only a few loose strands (mostly of the thicker size) recovered. |
| 7 | 81% | Clump still mostly intact with some loose fibers approximately ¼" in length recovered as well. |
| 10 | 88% | Clump and some loose fibers recovered on the screen. |
| 14 | 88% | Mostly loose fibers recovered, especially the thicker ones. |
| 21 | 85% (*) | (*) In this instance, the entire content of the bottle was filtered with a 125 μ mesh sieve in an attempt to recover bits and pieces of fiber which could have passed through the I mm opening mesh. As a result some wastewater solids were recovered on the screen and dried with the sample, which distorted the % weight loss number. Nevertheless, the result |

-continued

| Sample Day | % weight loss (<1 mm mesh) | Visual observation of fibers remaining on the No. 18 Sieve |
|---|---|---|
| | | suggests a high extent of fiber biodegradation and/or disintegration into extremely small particles. |
| 28 | 95% | Screened on the No. 18 sieve (1 mm openings). 1 large thick strand and some smaller fiber pieces were recovered. |

As shown by anaerobic disintegration, approximately 95% of the weight of the fiber disintegrated. This is evidence by less than 5% of the starting material being recovered on a sieve with 1 millimeter openings. Within 3 days, a high weight less occurs.

Anaerobic disintegration: The test materials and control products were dried, weighed and added to 2 L glass reactor bottles containing 1.5 L of anaerobic digester sludge. The bottles were capped with one-hole stoppers to allow the venting of evolved gases. Six reactors were prepared and were dosed with approximately 0.73 g of fibers each. The reactors were placed in an incubator set at 35° C. On days 2, 3, 7, 21, 28, 43 and 63 one of the bottles was harvested. The content of each reactor was poured onto a sieve with 1 mm mesh size. The sludge was gently rinsed off the remaining material. These were dried at 40° C. and weighed to calculate percent weight loss. Six reactors dosed with Tampax regular absorbency tampons were used as the control to verify sludge activity. They were harvested at the same time sequence as the test samples.

The anaerobic digester sludge was obtained from a wastewater treatment plant digester. Upon delivery, the sludge was immediately sieved through a 1 mm mesh screen and poured into a 30 gal. drum for mixing. From there it was transferred to the reactor bottles. During its handling the sludge was blanketed with nitrogen gas. Prior to use, the total solids of the sludge were measured in accordance with the standard operating procedure of the Paper Environmental Lab. The total solids of digester sludge must be above 15,000 mg/L. The total solids of the digester sludge used in this experiment was 21,200 mg/L. The quality criteria for the activity of the sludge requires that the control tampon material loses at least 95% of its initial dry weight after 28 days of exposure.

The samples were incubated in biologically active anaerobic digester sludge, but since evolved gases are not measured, the result is reported as percent disintegration not biodegradation. The rate and extent of disintegration is determined by the difference in weight of the initial sample and the dried weight of the sample recovered on a screen with 1 mm openings. Because the fibers were thin, pieces may have passed through the 1 mm mesh openings without extensive disintegration. The day 7 sample appeared to be about the same as day 3, so the sample and sludge were returned to the bottle and returned to the incubator for a later sampling. The same bottle was again harvested on day 63. The rate and extent of disintegration for each of the sampling time points are summarized in the following table.

Average percent weight loss over time and visual description of recovered residue:

| Sample Day | % weight loss (<1 mm mesh) | Visual Observation |
|---|---|---|
| 2 | 51% | Clump of fibers appears intact. |
| 3 | 53% | Clump of fibers appears mostly intact, but there are a few loose pieces of fiber. |
| 7 | — | Sample appeared the same as day 3 so it was returned to the reactor for later sampling. |
| 21 | 56% | Clump of fibers appear intact. |
| 28 | 64% | Clump of fibers appear intact. |
| 43 | 61% | Most of recovered sample is still in a clump but some loose fibers were recovered. |
| 63 | 70% | This was the day 7 sample that was returned to the incubator. The fibers were no longer in a clump, but were all loose pieces of fiber of various sizes. |

Example 11

The blend was compounded as in example 3 with 23 parts PLA, 45 parts StarDri 100, 23 parts Eastar Bio and 10 parts glycerine. The properties are in Table 1.

Example 12

The blend was compounded in a single step manner using a twin screw extruder. Solid polymer pellets, starch powder and sorbital powder are fed simultaneously into a co-rotating extruder. The blend is gradually heated in the following manner in each zone progressing from inlet to exit: zone A: 75° C., zone B: 75° C., zone 1: 150° C., zone 2: 155° C., zone 3: 155° C., zone 4: 160° C., zone 5: 160° C. The melt temperature was 185° C. measured at the outlet at a screw speed of 250 rpm. A vacuum was used to remove any residual water vapor in the last heating zone using a 4" Hg. The extrudate was cooled using cool air blown from air knives and directly palletized. The blend contained 43 parts Eastar Bio, 27 parts StarDri 100, 18 parts PLA and 12 parts sorbitol. Fibers were produced via a melt spinning process. The properties are in Table 1.

Example 13

The blend was compounded as in example 12 with 37 parts Eastar Bio, 33 parts StarDri 100, 16 parts PLA and 14 parts sorbitol. The properties are in Table 1.

Example 14

The blend was compounded as in example 12 with 20 parts Dow Primacor 5980I, 70 parts StarDri 100 and 30 parts sorbitol. The properties are in Table 1.

TABLE 1

Data for Examples 1–14
In the examples below, spinning behavior will be described as poor, acceptable, or good. Poor spinning refers to a total draw down ratio of less than about 1.5, acceptable spinning refers to a draw down ratio of from about 1.5 to about 10, and good spinning behavior refers to a draw down ratio of greater than about 10.

| Example | Tensile Strength (MPa) | Elongation at Break (%) | Spinning Behavior |
|---|---|---|---|
| 1 | 15.6 | 3.3 | Poor |
| 2 | 211 | 14.4 | Good |
| 3 | 0.5 | 1.3 | Acceptable |
| 4a | 26 | 1.8 | Good |
| 4b | 264 | 161 | Good |
| 5 | 68 | 12 | Good |
| 6 | 34 | 2 | Acceptable |
| 7 | 115 | 33 | Acceptable |
| 8 | 21 | 12 | Acceptable |
| 9 | 103 | 14 | Good |
| 11 | 35 | 52 | Good |
| 12 | 44 | 21 | Good |
| 13 | 49 | 14 | Good |
| 14 | 69 | 4 | Good |

Example 15

The blend was compounded using 70 parts StarDri 100, 10 parts Eastar Bio and 30 parts sorbital. Each ingredient is added concurrently to an extrusion system where they are mixed in progressively increasing temperatures. This procedure minimizes the thermal degradation to the starch that occurs when the starch is heated above 180° C. for significant periods of time. This procedure also allows the starch to be fully destructured before intimate mixing with the thermoplastic materials. Good spinning behavior was observed.

Example 16

The blend was compounded as in Example 15 using 60 parts StarDri 100, 10 parts Eastar Bio and 40 parts sorbital. Acceptable spinning behavior was observed.

Example 17

The blend was compounded as in Example 15 using 35 parts StarDri 100, 50 parts Eastar Bio and 15 parts sorbital. Good spinning behavior was observed.

Example 18

The blend was compounded as in Example 3 with 23 parts PLA, 45 parts StarDri 100, 23 parts Eastar Bio and 10 parts sorbital. Good spinning behavior was observed.

Example 19

The blend was compounded as in Example 3 with 23 parts amorphous PLA, 24 parts PLA, 45 parts StarDri 100 and 10 parts glycerine. Good spinning behavior was observed.

Example 20

The blend was compounded as in Example 15 with 8 parts amorphous PLA, 23 parts PLA, 31 parts StarDri 100, and 15 parts sorbital. Good spinning behavior was observed.

Example 21

The blend was compounded as in Example 3 with 23 parts amorphous PLA, 24 parts PLA, 45 parts StarDri 100 and 10 parts glycerine. Acceptable spinning behavior was observed.

Example 22

The blend was compounded as in Example 3 with 40 parts Bionolle 1020, 60 parts StarDri 100, 5 parts polycapralactone, 5 parts sorbitol and 10 parts glycerine. Acceptable spinning behavior was observed.

Example 23

The blend was compounded as in Example 3 with 50 parts Eastar Bio, 50 parts StarDri 100, 5 parts polycapralactone and 10 parts glycerine. Acceptable spinning behavior was observed.

Example 24

The blend was compounded as in Example 15 using 35 parts StarDri 100, 50 parts Eastar Bio, 8 parts mannitol, and 7 parts sorbital. Acceptable spinning behavior was observed.

Example 25

The blend was compounded as in Example 15 using 35 parts StarDri 100, 50 parts Eastar Bio, 8 parts mannitol, 7 parts sorbital and 3 parts glycerine. Acceptable spinning behavior was observed.

Example 26

The blend was compounded as in Example 15 using 50 parts Staley StaDex 10, 25 parts Eastar Bio and 50 parts sorbital. Acceptable spinning behavior was observed.

Example 27

The blend was compounded as in Example 15 using 50 parts Staley StaDex 10, 25 parts Eastar Bio, 0.2 parts magnesium stearate and 50 parts sorbital. Acceptable spinning behavior was observed.

Example 28

The blend was compounded as in Example 15 using 50 parts Staley StaDex 15, 25 parts Eastar Bio, 0.2 parts magnesium stearate and 50 parts sorbital. Acceptable spinning behavior was observed.

Example 29

The blend was compounded as in Example 15 using 60 parts Staley StaDex 15, 25 parts Eastar Bio, 0.2 parts magnesium stearate and 40 parts sorbital. Good spinning behavior was observed.

Example 30

The blend was compounded as in Example 15 using 30 parts Staley StaDex 15, 30 parts StaDex 65, 25 parts Eastar Bio, 0.2 parts magnesium stearate and 40 parts sorbital. Good spinning behavior was observed.

Example 31

The blend was compounded as in Example 15 using 35 parts Staley StaDex 15, 35 parts StaDex 65, 25 parts Eastar Bio, 0.2 parts magnesium stearate and 30 parts sorbital. Good spinning behavior was observed.

Example 32

The blend was compounded as in Example 15 using 5 parts StaDex 10, 20 parts Staley StaDex 15, 35 parts StaDex 65, 25 parts Eastar Bio, 0.2 parts magnesium stearate and 40 parts sorbital. Acceptable spinning behavior was observed.

Example 33

The blend was compounded as in Example 15 using 35 parts Staley StaDex 15, 35 parts StarDri 100, 25 parts Eastar Bio, 0.2 parts magnesium stearate and 30 parts sorbital. Acceptable spinning behavior was observed.

Example 34

The blend was compounded as in Example 15 using 40 parts StarDri100, 60 parts poly(3-hydroxybutyrate co-alkanoate), 3 parts polyhydroxybutyrate, 0.2 parts magnesium stearate and 15 parts sorbital. Acceptable spinning behavior was observed.

Example 35

The blend was compounded as in Example 15 using 40 parts StarDri100, 30 parts poly(3-hydroxybutyrate), 30 parts crystalline PLA, 0.2 parts magnesium stearate and 15 parts sorbital. Good spinning behavior was observed.

Example 36

The blend was compounded as in Example 15 using 40 parts StarDri100, 30 parts poly(3-hydroxybutyrate), 30 parts Bionolle 1020, 0.2 parts magnesium stearate and 15 parts sorbital. Acceptable spinning behavior was observed.

Example 37

The blend was compounded as in Example 15 using 40 parts StarDri100, 30 parts poly(3-hydroxybutyrate), 30 parts Eastar Bio, 0.2 parts magnesium stearate and 15 parts sorbital. Acceptable spinning behavior was observed.

Example 37

The blend was compounded as in Example 15 using 40 parts StarDri100, 30 parts Dow Primacore 5980I, 30 parts Eastar Bio, 0.2 parts magnesium stearate and 15 parts sorbital. Good spinning behavior was observed.

Example 38

The blend was compounded as in Example 15 using 40 parts StarDri100, 30 parts Dow Primacore 5990I, 30 parts Eastar Bio, 0.2 parts magnesium stearate and 15 parts sorbital. Good spinning behavior was observed.

Example 39

The blend was compounded as in Example 15 using 50 parts Staley StaDex 10, 25 parts Eastar Bio, 0.2 parts magnesium stearate and 50 parts sorbital. Acceptable spinning behavior was observed.

Example 40

The blend was compounded as in Example 15 using 50 parts Staley StaDex 15, 25 parts Eastar Bio, 15 parts polycaprolactone, 10 parts magnesium stearate and 50 parts sorbital. Acceptable spinning behavior was observed.

Example 41

The blend was compounded as in Example 15 using 60 parts Staley StaDex 15, 25 parts Eastar Bio, 10 parts magnesium stearate and 40 parts sorbital. Acceptable spinning behavior was observed.

Example 42

The blend was compounded as in Example 15 using 30 parts Staley StaDex 15, 30 parts StaDex 65, 25 parts Eastar Bio, 10 parts magnesium stearate and 40 parts sorbital. Good spinning behavior was observed.

Example 42

The blend was compounded as in Example 15 using 35 parts Staley StaDex 15, 35 parts StaDex 65, 25 parts Eastar Bio, 10 parts magnesium stearate and 30 parts sorbital. Good spinning behavior was observed.

Example 43

The blend was compounded as in Example 15 using 5 parts StaDex 10, 20 parts Staley StaDex 15, 35 parts StaDex 65, 25 parts Eastar Bio, 10 parts magnesium stearate and 40 parts sorbital. Acceptable spinning behavior was observed.

Example 44

The blend was compounded as in Example 15 using 35 parts Staley StaDex 15, 35 parts StarDri 100, 25 parts Eastar Bio, 10 parts magnesium stearate and 30 parts sorbital. Acceptable spinning behavior was observed.

Example 45

The blend was compounded as in Example 15 using 40 parts StarDri100, 30 parts polyvinyl alcohol, 30 parts Eastar Bio, 0.2 parts magnesium stearate and 15 parts sorbital. Acceptable spinning behavior was observed.

Example 46

The blend was compounded as in Example 15 using 40 parts StarDri100, 60 parts polyvinyl alcohol, 0.2 parts magnesium stearate and 15 parts sorbital. Acceptable spinning behavior was observed.

Example 47

The blend was compounded as in Example 15 using 60 parts StarDri100, 30 parts polyvinyl alcohol, 30 parts Eastar Bio, 0.2 parts magnesium stearate and 20 parts sorbital. Acceptable spinning behavior was observed.

Example 48

The blend can be compounded as in Example 15 using 50 parts StarDri100, 30 parts polyvinyl alcohol, 3 parts magnesium sulfate, 0.2 parts magnesium stearate and 18 parts sorbital.

Example 49

The blend can be compounded as in Example 15 using 50 parts StarDri100, 30 parts crystalline PLA, 10 parts amorphous PLA, 3 parts magnesium sulfate, 0.2 parts magnesium stearates, 7 parts gum rosin and 18 parts sorbital.

Example 50

The blend can be compounded as in Example 15 using 50 parts StarDri100, 30 parts poly(3-hydroxybutyrate), 3 parts magnesium sulfate, 0.2 parts magnesium stearates, 7 parts gum rosin, and 18 parts sorbital.

While particular examples were given, different combinations of materials, ratios, and equipment such as counter rotating twin screw or high shear single screw with venting could also be used.

The disclosures of all patents, patent applications (and any patents which issue thereon, as well as any corresponding published foreign patent applications), and publications mentioned throughout this description are hereby incorporated by reference herein. It is expressly not admitted, however, that any of the documents incorporated by reference herein teach or disclose the present invention.

While particular embodiments of the present invention have been illustrated and described, it would be obvious to those skilled in the art that various other changes and modifications can be made without departing from the spirit and scope of the invention. It is intended to cover in the appended claims all such changes and modifications that are within the scope of the invention.

What is claimed is:

1. A nonwoven web comprising an environmentally degradable, highly attenuated thermally bondable fiber produced by melt spinning a composition comprising:

a. destructurized starch, b. a biodegradable thermoplastic polymer having a molecular weight of less than about 400,000 g/mol; and c. a plasticizer.

2. A nonwoven web wherein the highly attenuated fibers of claim 1 are blended with other synthetic or natural fibers and bonded together.

3. An nonwoven web comprising envionrmentally degradable, highly attenuated fibers comprising destructurized starch, a biodegradable thermoplastic polymer having a molecular weight of from about 5,000 g/mol to about 400,000 g/mol, and a plasticizer.

4. A nonwoven web wherein the highly attenuated fibers of claim 3 are blended with other synthetic or natural fibers and bonded together.

* * * * *

UNITED STATES PATENT AND TRADEMARK OFFICE

CERTIFICATE OF CORRECTION

PATENT NO. : 6,890,872 B2
DATED : May 10, 2005
INVENTOR(S) : Bond et al.

It is certified that error appears in the above-identified patent and that said Letters Patent is hereby corrected as shown below:

Column 1,
Lines 34-35, "theological" should be -- rheological --.

Column 4,
Lines 37, "theological" should be -- rheological --.

Column 7,
Line 63, "lirniting" should be -- limiting --.

Signed and Sealed this

Sixth Day of September, 2005

JON W. DUDAS
*Director of the United States Patent and Trademark Office*